US008757573B1

(12) United States Patent
Barnes, Jr.

(10) Patent No.: US 8,757,573 B1
(45) **Date of Patent: *Jun. 24, 2014**

(54) ADJUSTABLE CUP HOLDER

(75) Inventor: John M. Barnes, Jr., Rock Hill, SC (US)

(73) Assignee: Drink Clip, LLC, Rock Hill, SC (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/563,106

(22) Filed: Jul. 31, 2012

Related U.S. Application Data

(63) Continuation of application No. 13/134,688, filed on Jun. 14, 2011, now Pat. No. 8,231,094, which is a continuation of application No. 12/315,407, filed on Dec. 3, 2008, now Pat. No. 7,959,121.

(51) Int. Cl.
*A47K 1/08* (2006.01)
*E04G 3/00* (2006.01)
*A45F 5/00* (2006.01)

(52) U.S. Cl.
USPC ..... 248/311.2; 248/278.1; 248/316.1; 248/313; 248/231.51; 224/148.4; 224/148.7; 224/558; 224/926; 220/737; 220/751

(58) Field of Classification Search
USPC ..... 248/311.2, 278.1, 316.1, 313, 231.51; 224/148.4, 148.7, 558, 926; 220/737, 220/751
See application file for complete search history.

(56) References Cited

U.S. PATENT DOCUMENTS 2,926,879 A * 3/1960 Dietrich ..... 248/311.2
3,814,367 A * 6/1974 Rasmussen ..... 248/311.2
4,131,259 A * 12/1978 Franks ..... 248/311.2
4,191,350 A * 3/1980 Ormond ..... 248/292.13
4,535,923 A * 8/1985 Manke ..... 224/550
4,708,273 A * 11/1987 Grant ..... 224/148.6
4,825,590 A 5/1989 Cullinane
4,887,784 A * 12/1989 Kayali ..... 248/311.2
4,997,156 A * 3/1991 Allen ..... 248/311.2
5,014,956 A * 5/1991 Kayali ..... 248/311.2
5,191,679 A 3/1993 Harper
5,320,263 A * 6/1994 Kobylack ..... 224/274
5,340,006 A 8/1994 Li
5,423,508 A * 6/1995 Isenga et al. ..... 248/311.2
5,853,158 A * 12/1998 Riggle ..... 248/311.2
6,045,017 A * 4/2000 Connell ..... 224/148.7
6,220,557 B1 4/2001 Ziaylek et al.

(Continued)

OTHER PUBLICATIONS

Cabela's Catelog Advertisement; "Rail/Mount Drink Holder"; p. 97; published prior to Dec. 3, 2008.

*Primary Examiner* — Terrell McKinnon
*Assistant Examiner* — Christopher Garft
(74) *Attorney, Agent, or Firm* — Schwartz Law Firm, P.C.

(57) ABSTRACT

An adjustable cup holder incorporates an elongated clamp assembly and cup support assembly. The clamp assembly has a proximal end and a distal clamping end. The cup support assembly is connected at the proximal end of the clamp assembly, and comprises a body portion and a pair of arcuate cup-encircling arms having respective spaced-apart free ends. A pivot pin enables pivot adjustment of the cup support assembly at the proximal end of the clamp assembly, such that the cup support assembly is movable between a desired in-use position depending from the clamp assembly, and a folded stowed position beside the clamp assembly. In the stowed position, the clamp assembly passes between the spaced-apart free ends of the cup-encircling arms and into an area defined between the cup-encircling arms.

12 Claims, 8 Drawing Sheets

(56) References Cited

U.S. PATENT DOCUMENTS

| | | | | |
|---|---|---|---|---|
| 6,227,511 | B1 * | 5/2001 | De Costa | 248/311.2 |
| 6,409,137 | B1 * | 6/2002 | Tran | 248/311.2 |
| 6,457,616 | B2 * | 10/2002 | Gagne | 224/148.4 |
| 7,284,737 | B2 * | 10/2007 | Kane | 248/311.2 |
| 7,300,031 | B2 * | 11/2007 | Bertsch et al. | 248/311.2 |
| 8,066,148 | B2 * | 11/2011 | Garahan | 220/737 |
| 2001/0013568 | A1 * | 8/2001 | Berenguer | 248/311.2 |
| 2004/0238577 | A1 | 12/2004 | Shivas | |
| 2006/0081750 | A1 * | 4/2006 | Kazyaka | 248/311.2 |
| 2007/0210229 | A1 * | 9/2007 | Brenner et al. | 248/311.2 |
| 2010/0096396 | A1 | 4/2010 | Doig et al. | |

* cited by examiner

ADJUSTABLE CUP HOLDER

TECHNICAL FIELD AND BACKGROUND

The present disclosure relates broadly and generally to an adjustable cup holder. In exemplary embodiments and implementations of the invention, discussed herein, the cup holder is applicable for carrying various food or beverage containers (including disposable cups, drinking glasses, cans, bottles, cartons, and the like), and any other storage vessel containing spillable contents, such as hardware including nails, screws, nuts, bolts, washers, and others.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises an adjustable cup holder incorporating an elongated clamp assembly and cup support assembly. The clamp assembly has a proximal end and a distal clamping end. The cup support assembly is connected (directly or indirectly) at the proximal end of the clamp assembly, and comprises a body portion and a pair of arcuate cup-encircling arms having respective spaced-apart free ends. Means are provided for pivoting the cup support assembly at the proximal end of the clamp assembly, such that the cup support assembly is movable between a desired in-use position depending from the clamp assembly, and a folded stowed position beside the clamp assembly. In the stowed position, the clamp assembly passes between the spaced-apart free ends of the cup-encircling arms and into an area defined between the cup-encircling arms.

The term "cup" refers broadly herein to any vessel or container, such as that designed for carrying spillable contents.

As used herein, the term "cup-encircling" means extending adjacent or around (or capable of extending adjacent or around) at least a portion of an outer periphery of a cup when placed in the cup holder. For example, the cup-encircling arms may extend around at least 50 percent of the outer periphery of the cup. In another example, the cup-encircling arms may extend around at least 80% of the outer periphery of the cup.

According to another exemplary embodiment, an angled foot is located at a base of the body portion of the cup support assembly, and is adapted for engaging a bottom of a cup carried by the cup holder.

According to another exemplary embodiment, the foot extends substantially perpendicular to the body portion of the cup support assembly.

According to another exemplary embodiment, a locking tab extends from the distal clamping end of the clamp assembly, and the angled foot of the cup support assembly defines a complementary slot for releasably receiving the locking tab with the cup support assembly in the folded stowed position.

According to another exemplary embodiment, the cup-encircling arms of the cup support assembly comprise respective substantially flat and tapered cup-engaging surface areas.

According to another exemplary embodiment, the clamp assembly comprises a spring-biased pivoted handle.

According to another exemplary embodiment, the pivoted handle comprises cooperating upper and lower jaws.

According to another exemplary embodiment, the clamp assembly further comprises a pivot stop adjacent its proximal end for limiting pivoting movement of the cup support assembly in the in-use position.

According to another exemplary embodiment, an assembly connector is provided adjacent the proximal end of the clamp assembly for releasably interconnecting the clamp assembly and the cup support assembly.

According to another exemplary embodiment, the assembly connector comprises a raised head received within a complementary opening defined by the body portion of the cup support assembly. The raised head is adapted for allowing swivel adjustment of the cup support assembly relative to the clamp assembly.

According to another exemplary embodiment, an attachment clip is located on the cup support assembly, and is adapted for attaching the cup holder to a belt of a user.

According to another exemplary embodiment, respective free ends of the cup-encircling arms are spaced-apart a distance (e.g., at least 1 inch) sufficient to allow unobstructed passage of the clamp assembly through the cup-encircling arms and inside the open space defined between the arms to its stowed position.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
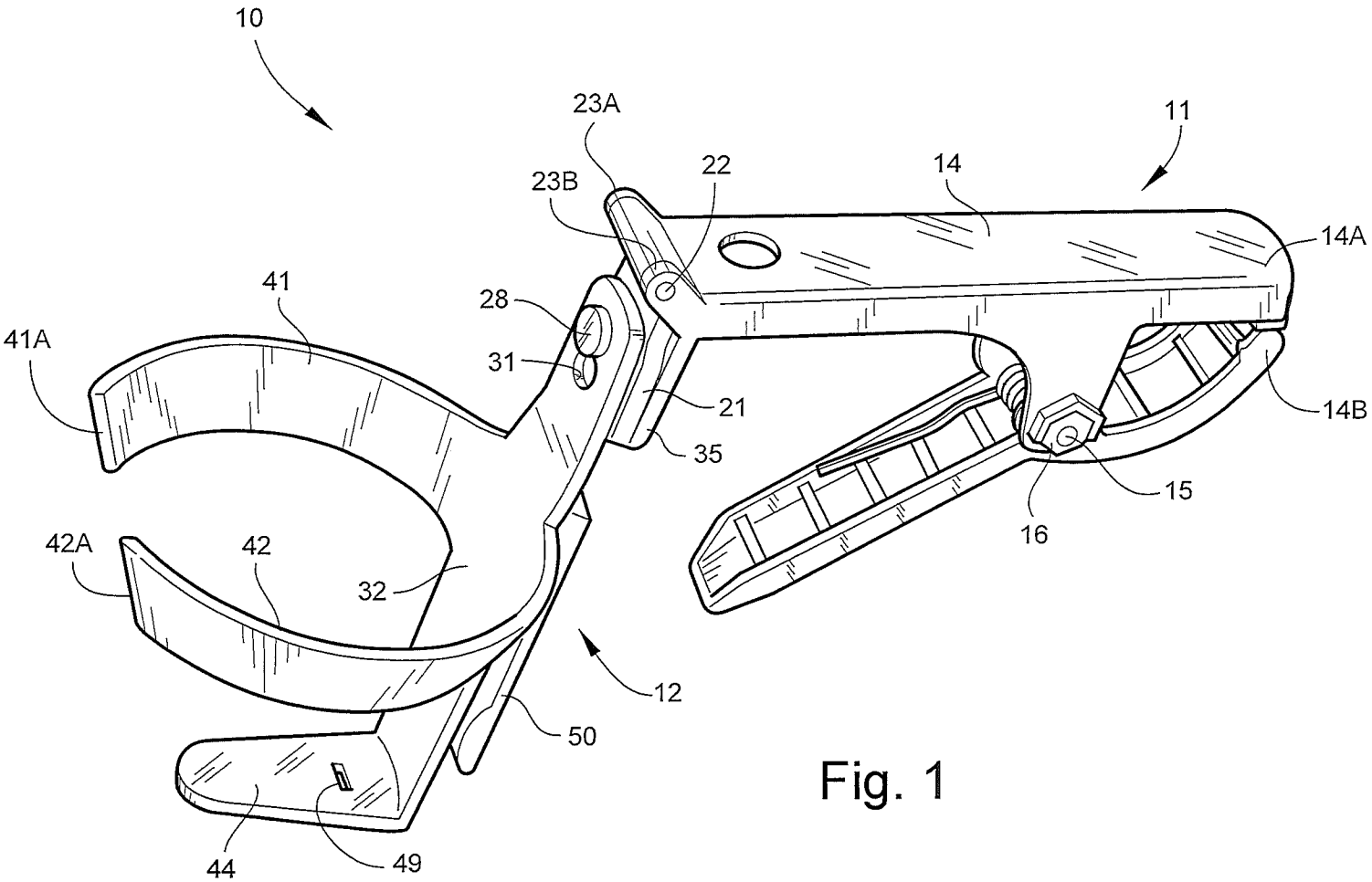
FIG. 1 is a perspective view of an adjustable cup holder according to one exemplary embodiment of the present disclosure.

Referring now specifically to the drawings, an adjustable cup holder according to one exemplary embodiment of the present invention is illustrated in FIG. 1, and shown generally at reference numeral 10. As indicated above, the exemplary cup holder 10 is especially applicable for carrying food or beverage containers (including disposable cups, drinking glasses, cans, bottles, cartons, and the like), and any other storage vessel containing spillable contents.

Figure 2:
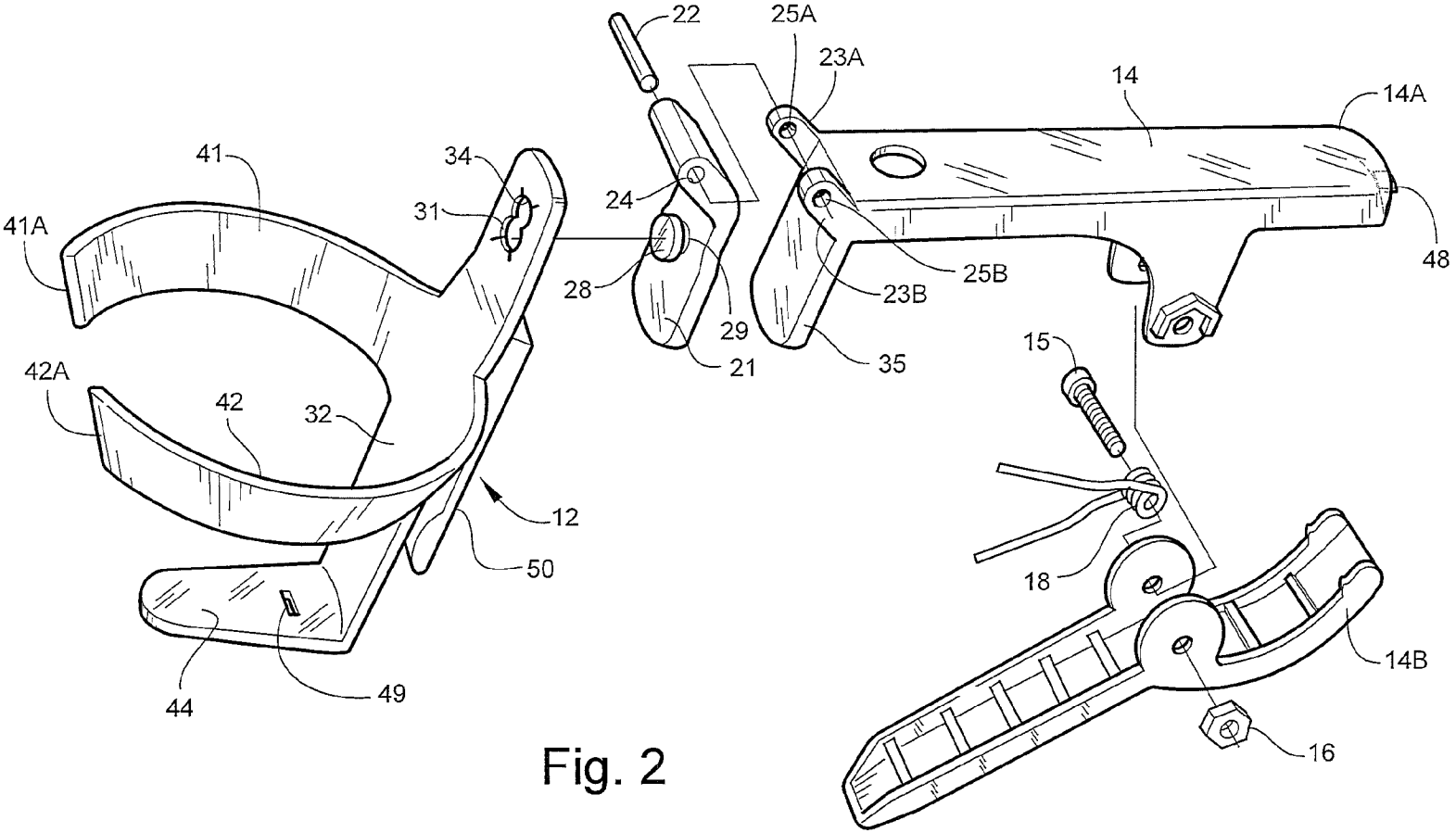
FIG. 2 is an exploded view of the adjustable cup holder.

As best show in FIGS. 1 and 2, the cup holder 10 incorporates a separately attached and detachable elongated clamp assembly 11 and cup support assembly 12. The exemplary clamp assembly 11 comprises a spring-biased handle 14 having a proximal end pivotably attached to the cup support assembly 12, and a distal clamping end including cooperating upper and lower jaws 14A and 14B. The lower jaw 14B is pivotably attached to the upper jaw 14A using a complementary threaded pivot bolt 15 and nut 16, and is biased in a normally closed condition by spring 18. The jaws 14A, 14B are opened by grasping and squeezing the handle 14 to pivot the lower jaw 14B away from the upper jaw 14A against the biasing force of spring 18.

Figure 5:
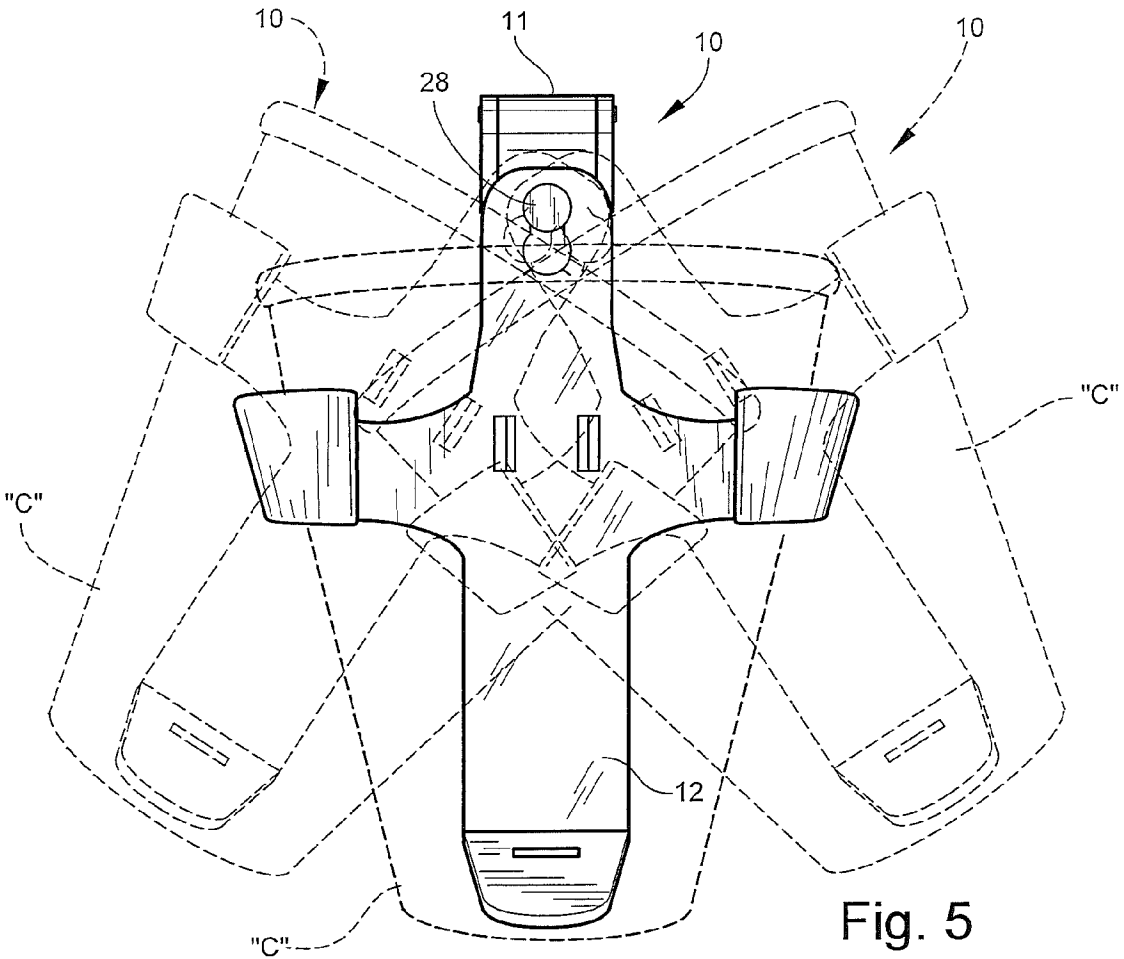
FIG. 5 is a front elevation of the adjustable cup holder, and demonstrating swivel adjustment of the cup support assembly relative to the clamp assembly.

An assembly connector 21 pivotably joins the clamp assembly 11 at its proximal end to the cup support assembly 12. The assembly connector 21, best shown in FIG. 2, is carried by an elongated pivot pin 22 held within spaced journal tabs 23A, 23B formed with the proximal end of the clamp assembly 11. The pivot pin 22 extends within a cylindrical through-bore 24 formed with the assembly connector 21, and projects outwardly from opposing sides of the assembly connector 21 into respective pin openings 25A, 25B of journal tabs 23A, 23B. The assembly connector 21 further comprises an integrally-molded, raised annular head 28 and reduced-diameter neck 29. To assemble the clamp and cup support assemblies 11, 12, the annular head 28 is initially passed through a first relatively large opening 31 formed with a body portion 32 of the cup support assembly 12. The cup support assembly 12 is then dropped slightly such that the reduced-diameter neck 29 locates within an adjacent smaller opening 34. Because the head diameter is larger than that of the smaller opening 34, the head 28 loosely attaches the cup support assembly 12 to the pivoted connector 21 and clamp assembly 11. The cup support assembly 12 freely pivots at pin 22 and self-adjusts (by force of gravity) relative to the clamp assembly 11, and can freely swivel about the head 28 of the assembly connector 360 degrees relative to the clamp assembly 11, as demonstrated in FIG. 5. A pivot stop 35 may be formed adjacent the proximal end of the clamp assembly 11 to stabilize and limit pivoting movement of the cup support assembly 12 in an in-use position, such as shown in FIGS. 6, 7 and 8.

Figure 3:
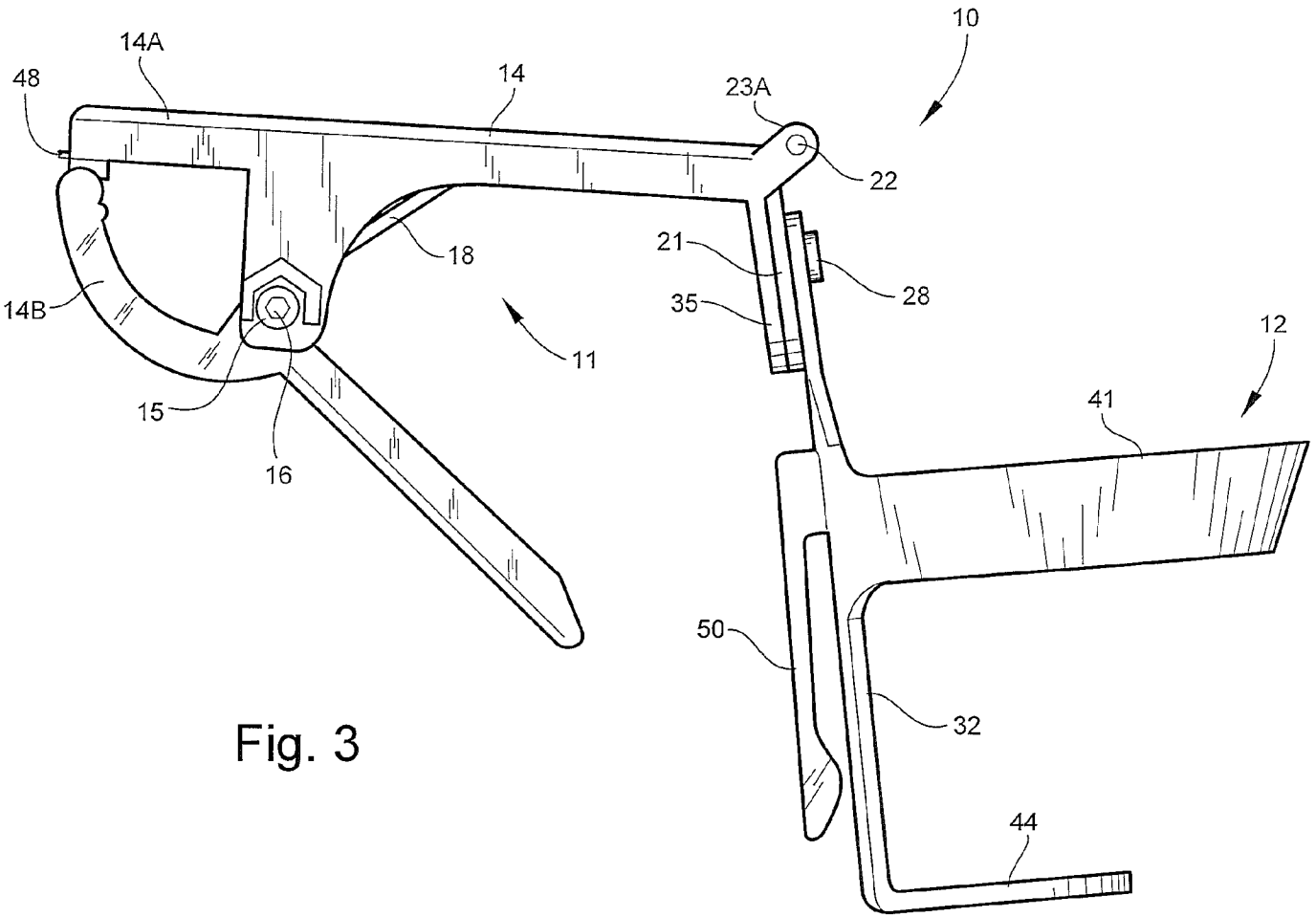
FIG. 3 is a side elevation of the adjustable cup holder.
Figure 4:
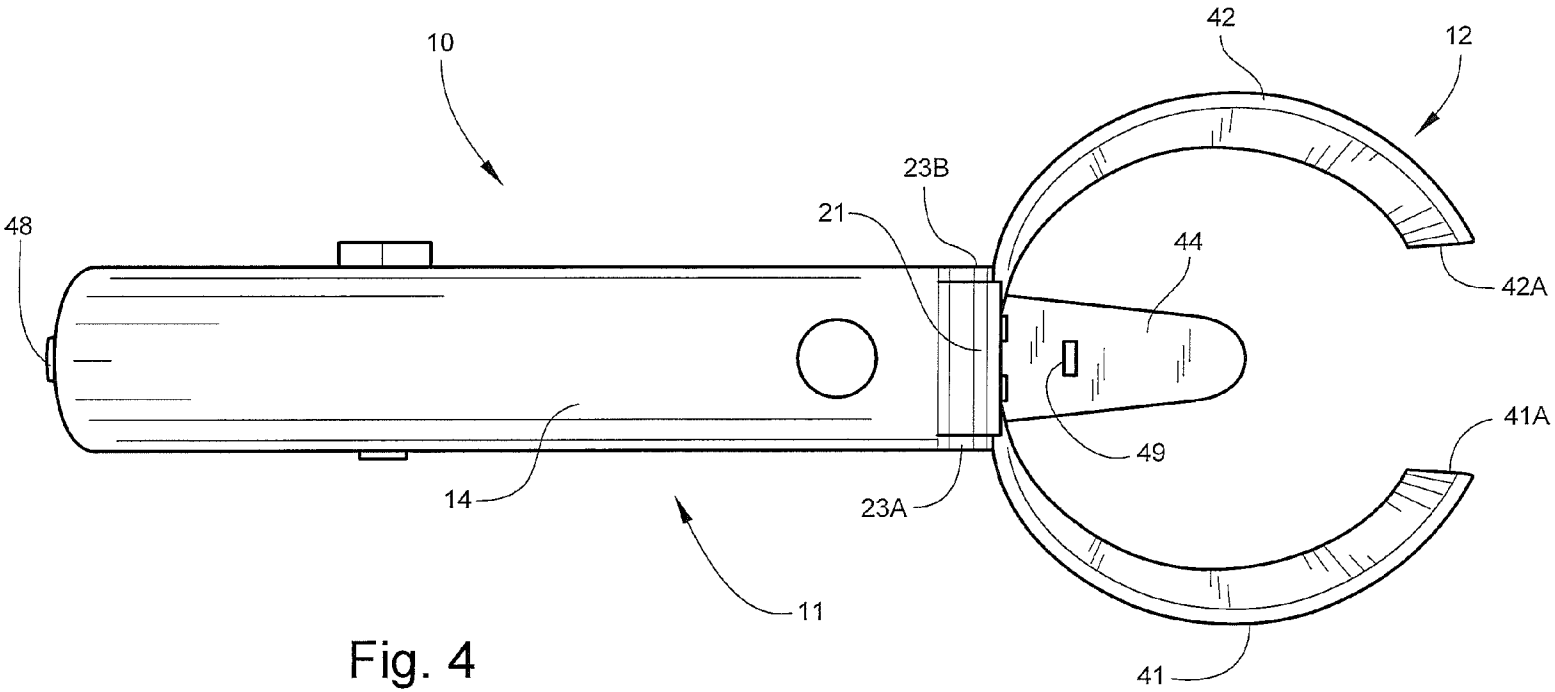
FIG. 4 is a top plan view of the adjustable cup holder.

Referring to FIGS. 2, 3, and 4, the cup support assembly 12 comprises a pair of arcuate cup-encircling arms 41 and 42 formed with its elongated body portion 32, and an angled foot 44 formed at a base of the body portion 32. The cup-encircling arms 41, 42 have respective spaced-apart free ends 41A, 42A. The free ends 41A, 42A are sufficiently spaced (e.g., between 1-3 inches) to allow unobstructed passage of the clamp assembly 11 when the cup holder 10 is pivoted, as described below, from the in-use position to a folded or stowed position shown in FIG. 9. Additionally, the cup-encircling arms 41, 42 may be slightly tapered or inwardly angled to define respective flat, cup-engaging surface areas well suited for generally conical cup shapes. The angled foot 44 may extend substantially perpendicular to the body portion 32 of the cup support assembly 12 to engage and support a bottom of a cup held within the cup holder 10.

Figure 6:
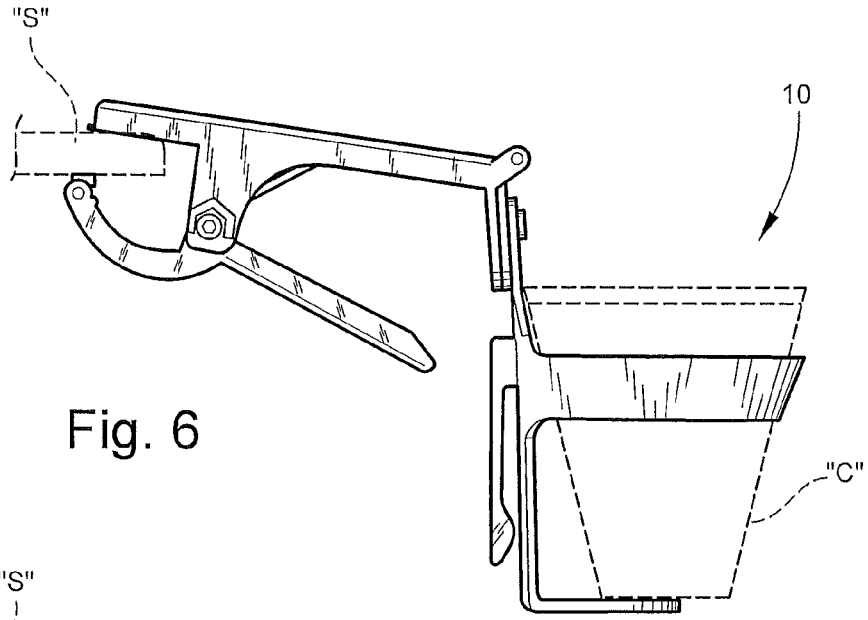
FIGS. 6, 7, and 8 are respective environmental views of the adjustable cup holder.
Figure 7:
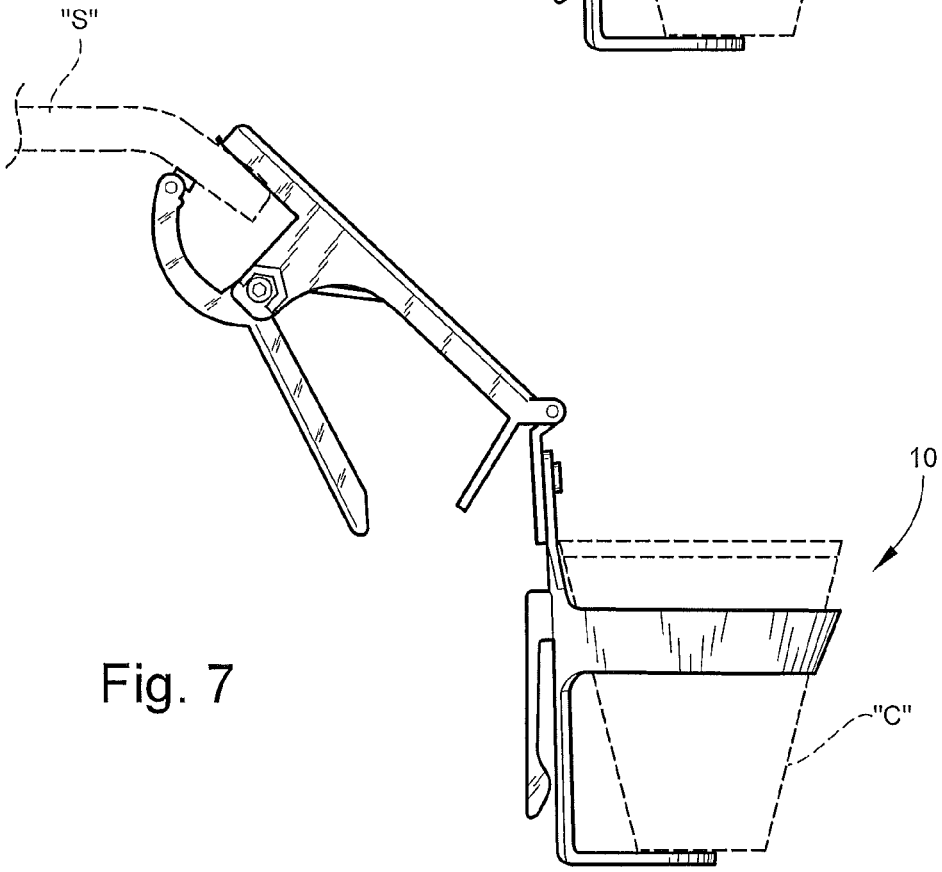
Figure 8:
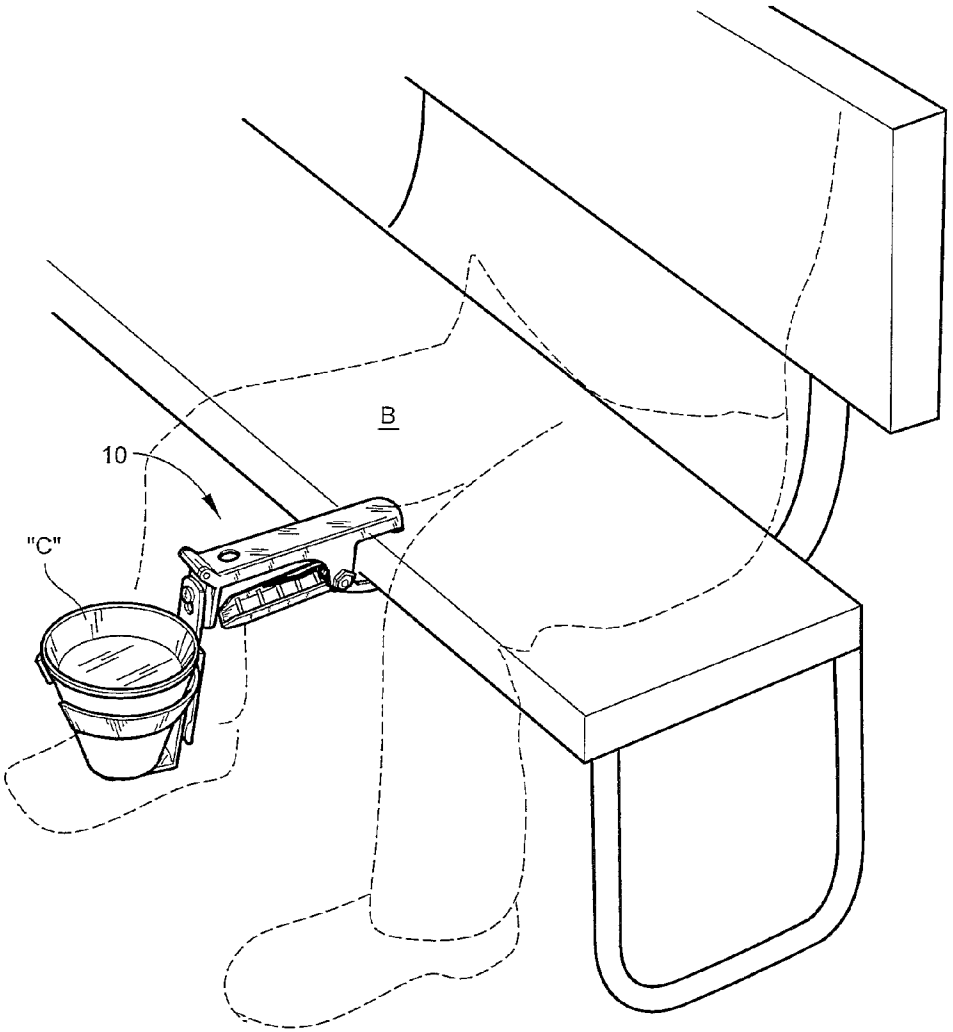

FIGS. 6-8 demonstrate various implementations of the exemplary cup holder 10. FIG. 6 shows the cup holder 10 clamped to a generally horizontal structure "S", whereas the structure "S" in FIG. 7 is angled downwardly. In each case, the cup holder 10 effectively supports the cup "C" in a balanced and stable condition. FIG. 8 shows the exemplary cup holder 10 used on bleacher seating "B" common in most athletic stadiums.

Figures 9, 9A:
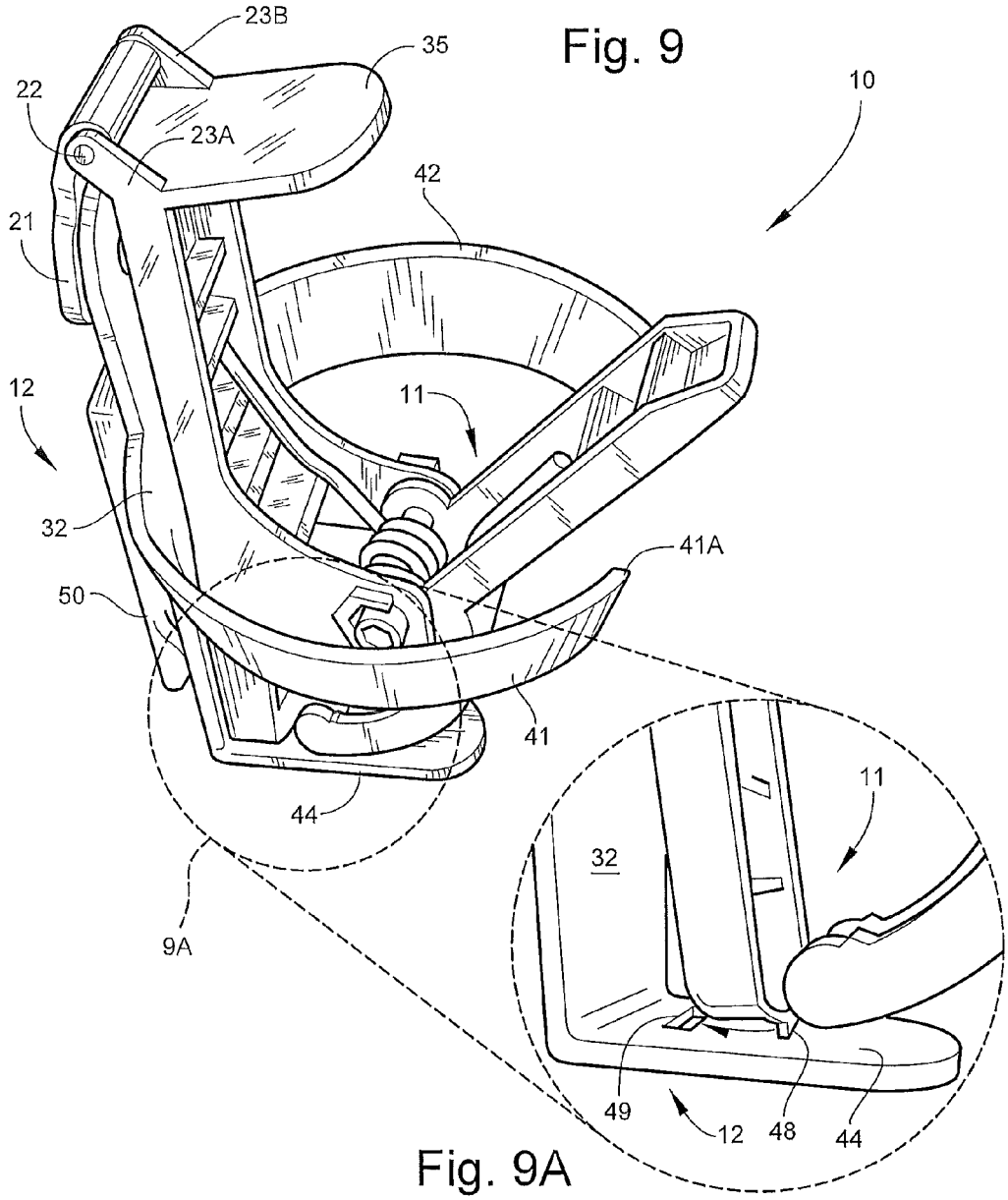
FIG. 9 is a perspective view of the adjustable cup holder folded in a stowed position.
FIG. 9A is an enlarged fragmentary view of the adjustable cup holder, and demonstrating insertion of the locking tab of the clamp assembly into the slot of the cup support assembly to releasably lock the cup holder in the stowed position.

Referring to FIGS. 9 and 9A, the cup holder 10 is convertible from the in-use position, discussed above and shown in FIGS. 6-8, to the stowed position, shown in FIG. 9, by folding the clamp assembly 11 and cup support assembly 12 together such that the handle 14 passes between the spaced-apart free ends 41A, 42A of the cup-encircling arms 41, 42 and into an area adjacent the body portion 32. As best shown in FIG. 9A, a locking tab 48 extends from the distal clamping end of the clamp assembly 11 and inserts into a complementary slot 49 formed with the angled foot 44 of the cup support assembly 12 to releasably lock the cup holder 10 in the stowed position. In the stowed position, the cup holder 10 may be conveniently carried at the waist of a user (e.g., on a belt) using an attached clip 50 formed with the body portion 32 of the cup support assembly 12.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. An adjustable cup holder, comprising:

an elongated clamp assembly having a proximal end and a distal clamping end;

a cup support assembly located at the proximal end of said clamp assembly, and comprising a body portion having a base, and an angled foot located at said base and adapted for engaging a bottom of a cup carried by said cup holder;

a pivotable assembly connector adjacent the proximal end of said clamp assembly for pivotably interconnecting said clamp assembly and said cup support assembly, such that said cup support assembly is movable between a desired in-use position depending from said clamp assembly, and a folded stowed position beside said clamp assembly; and a locking tab extending from the distal clamping end of said clamp assembly, and wherein said angled foot of said cup support assembly defines a complementary slot for releasably receiving said locking tab with said cup support assembly in the folded stowed position.

2. An adjustable cup holder according to claim 1, wherein said foot extends substantially perpendicular to the body portion of said cup support assembly.

3. An adjustable cup holder according to claim 1, wherein said clamp assembly comprises a spring-biased pivoted handle.

4. An adjustable cup holder according to claim 3, wherein said pivoted handle comprises cooperating upper and lower jaws.

5. An adjustable cup holder according to claim 1, wherein said clamp assembly further comprises a pivot stop adjacent its proximal end for limiting pivoting movement of said cup support assembly in the in-use position.

6. An adjustable cup holder according to claim 1, wherein said assembly connector comprises a raised head received within a complementary opening defined by a body portion of said cup support assembly, and adapted for allowing swivel adjustment of said cup support assembly relative to said clamp assembly.

7. An adjustable cup holder according to claim 1, and comprising an attachment clip located on said cup support assembly, and adapted for attaching said cup holder to a belt of a user.

8. An adjustable cup holder, comprising:

an elongated clamp assembly having a proximal end and a distal clamping end, and said clamp assembly comprising a spring-biased pivoted handle with cooperating upper and lower jaws;

a cup support assembly located at the proximal end of said clamp assembly, and comprising an angled foot adapted for engaging a bottom of a cup carried by said cup holder; and a pivotable assembly connector adjacent the proximal end of said clamp assembly for pivotably interconnecting said clamp assembly and said cup support assembly, such that said cup support assembly is movable between a desired in-use position depending from said clamp assembly, and a folded stowed position beside said clamp assembly; and a locking tab extending from the distal clamping end of said clamp assembly, and wherein said angled foot of said cup support assembly defines a complementary slot for receiving said locking tab with said cup support assembly in the folded stowed position.

9. An adjustable cup holder according to claim 8, wherein said angled foot extends substantially perpendicular to a body portion of said cup support assembly.

10. An adjustable cup holder according to claim 8, wherein said clamp assembly further comprises a pivot stop adjacent its proximal end for limiting pivoting movement of said cup support assembly in the in-use position.

11. An adjustable cup holder according to claim 8, wherein said assembly connector comprises a raised head received within a complementary opening defined by a body portion of said cup support assembly, and adapted for allowing swivel adjustment of said cup support assembly relative to said clamp assembly.

12. An adjustable cup holder according to claim 8, and comprising an attachment clip located on said cup support assembly, and adapted for attaching said cup holder to a belt of a user.

* * * * *